US008113156B2

(12) United States Patent
Stretch et al.

(10) Patent No.: US 8,113,156 B2
(45) Date of Patent: Feb. 14, 2012

(54) ENERGY RECOVERY SYSTEM FOR AN ADDED MOTION SYSTEM

(75) Inventors: Dale A. Stretch, Novi, MI (US); Matthew P. Scarbrough, Canton, MI (US); John Douglas Auxier, Jr., Howell, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 12/890,168

(22) Filed: Sep. 24, 2010

(65) Prior Publication Data

US 2011/0011357 A1 Jan. 20, 2011

Related U.S. Application Data

(63) Continuation of application No. 11/758,757, filed on Jun. 6, 2007, now abandoned.

(60) Provisional application No. 60/817,768, filed on Jun. 30, 2006.

(51) Int. Cl.
*F01L 9/02* (2006.01)

(52) U.S. Cl. ..... 123/90.12; 123/90.16

(58) Field of Classification Search ..... 123/90.12, 123/90.15, 90.16; 251/251
See application file for complete search history.

(56) References Cited

U.S. PATENT DOCUMENTS

| | | | |
|---|---|---|---|
| 3,140,698 | A | 7/1964 | Voorhies |
| 3,938,483 | A | 2/1976 | Firey |
| 4,009,694 | A | 3/1977 | Firey |
| 4,373,477 | A | 2/1983 | Buente et al. |
| 4,671,221 | A | 6/1987 | Geringer et al. |
| 4,862,844 | A | 9/1989 | Wakeman et al. |
| 4,972,761 | A | 11/1990 | Thomsen et al. |
| 5,251,587 | A | 10/1993 | Mori et al. |
| 5,460,129 | A | 10/1995 | Miller et al. |
| 5,640,934 | A | 6/1997 | Mori et al. |
| 5,680,841 | A | 10/1997 | Hu |
| 6,006,706 | A | 12/1999 | Kanzaki |
| 6,223,846 | B1 | 5/2001 | Schechter |
| 6,321,706 | B1 | 11/2001 | Wing |
| 6,457,487 | B1 | 10/2002 | Stephenson et al. |
| 6,477,997 | B1 | 11/2002 | Wakeman |
| 6,655,349 | B1 | 12/2003 | Cavanagh |
| 6,732,685 | B2 | 5/2004 | Leman |
| 2002/0017256 | A1 | 2/2002 | Shiraishi et al. |
| 2002/0066428 | A1 | 6/2002 | Kammerdiener et al. |
| 2005/0087716 | A1 | 4/2005 | Udd |
| 2005/0205019 | A1 | 9/2005 | Burk et al. |
| 2005/0205065 | A1 | 9/2005 | Rembold et al. |

OTHER PUBLICATIONS

Office Action for U.S. Appl. No. 11/758,757 mailedApr. 29, 2009.
Office Action for U.S. Appl. No. 11/758,757 mailed Dec. 2, 2009.
Office Action for U.S. Appl. No. 11/758,757 mailed Jul. 2, 2010.

*Primary Examiner* — Zelalem Eshete
(74) *Attorney, Agent, or Firm* — Honigman Miller Schwartz and Cohn LLP

(57) ABSTRACT

A hydraulic circuit is disclosed. The hydraulic circuit includes an actuating mechanism having an engine valve and an engine valve spring, an added motion valve system having a cam system, a valve in fluid communication with the actuator mechanism, and a dump valve and at least one check valve in fluid communication with the valve to allow a recovery of energy stored in an engine valve spring during closing movement of the engine valve associated with the added motion system. A method for controlling a hydraulic circuit is also disclosed.

15 Claims, 8 Drawing Sheets

ENERGY RECOVERY SYSTEM FOR AN ADDED MOTION SYSTEM

RELATED APPLICATION

This application is a continuation application of U.S. Ser. No. 11/758,757 filed on Jun. 6, 2007, which claims priority to U.S. Provisional Patent Application No. 60/817,768 filed on Jun. 30, 2006.

TECHNICAL FIELD

The present disclosure relates generally to a system that provides a delayed closing movement of an engine valve of an internal combustion engine, including a system that recovers energy stored in an engine valve spring during the delayed closing movement of an engine valve.

BACKGROUND

It is known in the art that a cam system, which may include, for example, a cam shaft and rocker arm, can be used to open and close the valves of an internal combustion (IC) engine. It is also known in the art that the timing of valve closure during an IC engine's induction stroke may be varied to, among other things, optimize engine performance.

During the initial movement of an engine valve, a cam system typically compresses an engine valve spring, and, accordingly, stores energy in the compressed spring that may be utilized during the closing stroke to provide torsional power back to the cam system. As such, the torque fed back to the cam system can reduce power demands on the engine associated with the operation of the cam system.

In some systems, the closing of an engine valve can be delayed for a period of time, by, for example, a hydraulic force actuator that counteracts the closing force of an associated engine valve spring. Systems that exhibit such a delayed closing movement of the engine valve are commonly referred to as "added motion" systems.

During the closing movement of a valve in an added motion system, fluid associated with a hydraulic force actuator may be utilized to close/seat the engine valve and, as such, bypasses the energy stored in the valve spring that would otherwise have been fed back as torsional power to a cam system. Accordingly, the energy stored in the engine valve spring is dissipated into (i.e., "lost") in the hydraulic fluid system associated with the hydraulic force actuator. More specifically, when the hydraulic force actuator is opened, the energy is dissipated into the hydraulic fluid system by way of the spring force, which causes an increased flow of fluid at a higher velocity toward a reservoir of the hydraulic fluid system. In some circumstances, the energy stored in the engine valve spring is dissipated by heat that is created from friction as the fluid flows, with the increased velocity, through fluid flow orifices of the hydraulic fluid system. Accordingly, a net loss of power resulting from "lost" energy of the valve spring may place higher power demands on the IC engine for operating the cam system.

Accordingly, it would be desirable to prevent a loss of/recover energy from the engine valve spring during a delayed "added motion" closing movement. For example, energy recovered from the valve spring during a closing movement in an added motion system could be returned to the cam operating system and used to reduce power demands placed on the engine for operating the cam system.

BRIEF DESCRIPTION OF THE DRAWINGS

Embodiments of the disclosure will now be described, by way of example, with reference to the accompanying exemplary drawings, wherein.

DETAILED DESCRIPTION

Figure 1:
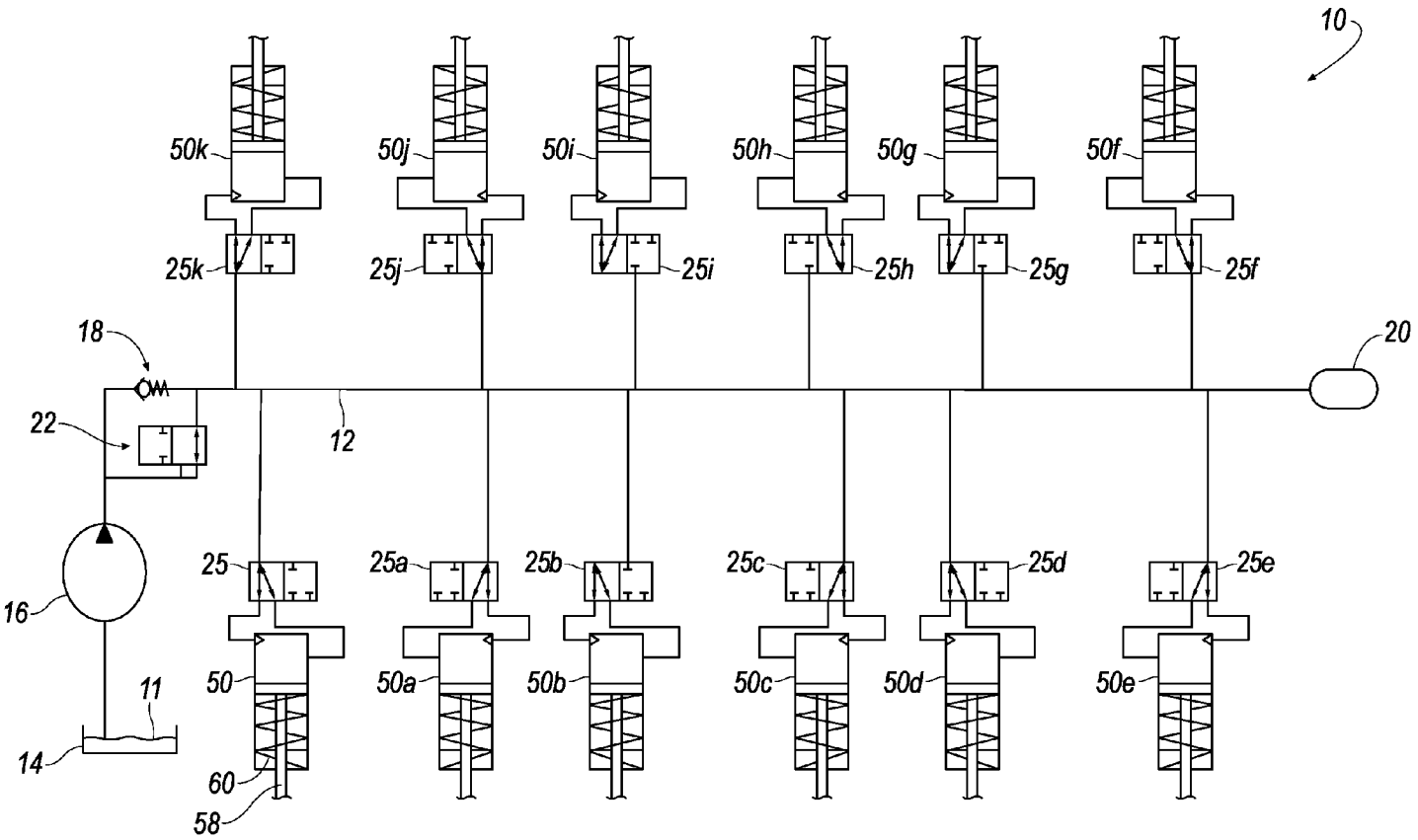
FIG. 1 is a hydraulic schematic for operating one or more added motion valve systems according to an embodiment of the present invention.

A hydraulic circuit 10 according to an embodiment of the present invention is shown in FIG. 1. The hydraulic circuit 10, which may be employed in connection with an internal combustion (IC) engine, includes a plurality of valves 25-25*k* and actuating mechanisms 50-50*k*. Embodiments of a valve 25, an actuating mechanism 50, and a representative view of a cam system 75 are generally shown in cross-section in FIG. 2. The valve 25, actuating mechanism 50, and cam system 75 may also be collectively referred to as an added motion valve system (generally identified as 100).

Cam system 75 may include a camshaft 77, rocker arm 79, and rocker arm roller 81. The actuating mechanism 50 may include, among other things, a valve body 52 having a bore 54, a piston 56, an engine valve 58, and a valve spring 60. If desired, valve 25 may include a solenoid valve that permits or impedes the flow or movement of fluid 11 (i.e., fluid under pressure) from a pressure rail 12 to, for example, an upper portion 62 of the bore 54 associated with the actuating mechanism 50. The upper portion 62 of the bore 54 may also define and be referred to as an actuator fluid volume. As illustrated, fluid 11 may also be communicated from the valve 25 (prior to intake of the engine valve 58) to a subsequent valve 25*a*-25*k* in the hydraulic circuit 10 (of FIG. 1).

Referring to FIG. 1, fluid 11 (e.g., a fluid under atmospheric pressure) is drawn from a sump 14 by a pump 16 and is pumped or otherwise introduced and permitted passage into pressure rail 12 of the hydraulic circuit 10. The pump 16 may be, for example, an engine pump. As shown in the illustrated embodiment, the fluid 11 may be drawn by the pump 16 to the pressure rail 12 by flowing through a valve, such as a one-way directional flow check valve 18.

An accumulator 20 is included with or in communication with the pressure rail 12 to help influence or control the pressure dynamics associated with the fluid 11 within the pressure rail 12. The pressure dynamics of the fluid 11 in the pressure rail 12 are affected by, among other things, the pulsing of the fluid 11 in the rail 12 associated with, for example, the moving or exchange of fluid 11 from one actuator (e.g., first valve 25) into another actuator (e.g., second valve 25*a*). Accordingly, the accumulator 20 may act as a compliant reservoir that stores fluid 11 that is exited from the valve 25 to valve 25*a* so as to reduce or damp out pulsed-wave dynamics of the fluid 11 being pulled in and pushed out of the pressure rail 12 prior to the fluid 11 being drawn into one of the valves 25-25*k* connected to the pressure rail 12.

Figure 2:
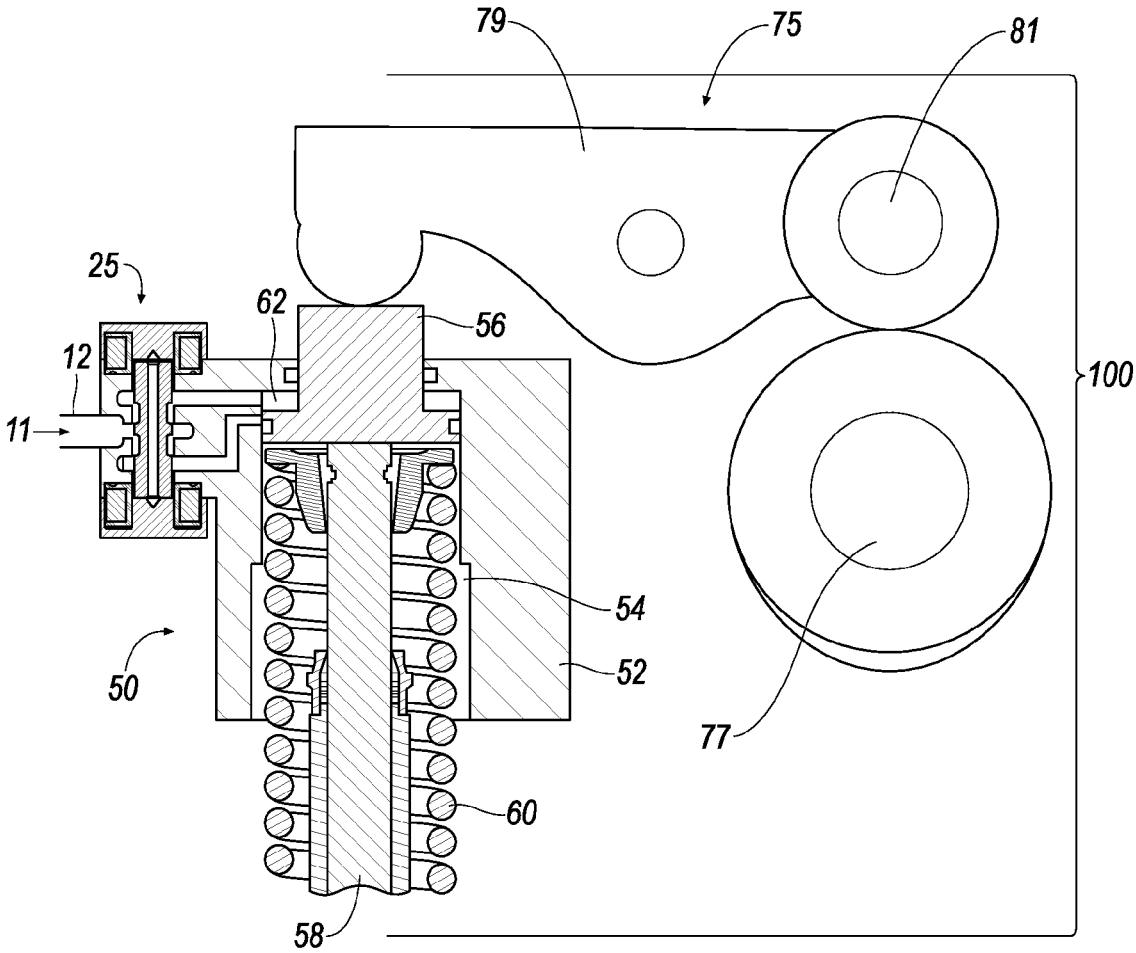
FIG. 2 is a diagram of an added motion valve system according to an embodiment of the present invention.
Figure 3:
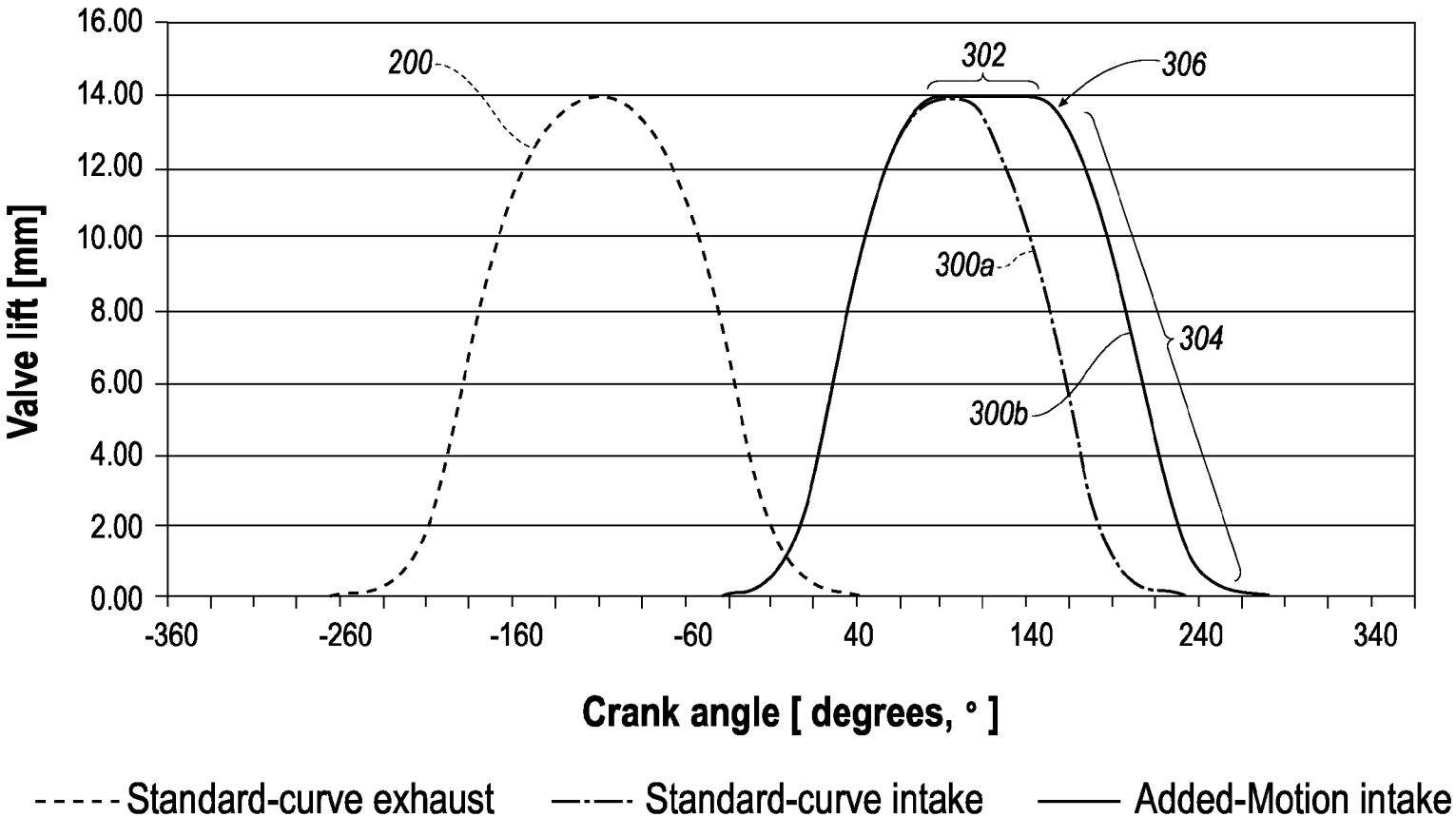
FIG. 3 is a table generally illustrating valve lift profiles for embodiments of an added motion valve system.

With reference to FIGS. 2 and 3, as rotation of the camshaft 77 causes reciprocating movement of a rocker arm 79 and piston 56, a valve lift standard curve on the exhaust stroke of the engine valve 58 is shown generally designated as 200 and a valve lift standard curve on the intake stroke of the engine valve 58 is shown generally designated as 300*a*. However, for example, when the valve 25 permits fluid 11 to enter the bore 54 during the intake stroke of the engine valve 58 at, for instance, a moment of full engine valve lift, the intake stroke of the engine valve 58 may be delayed or locked. Such delay or lock provides an "added motion" movement to the engine valve 58. An added motion valve lift intake curve of the engine valve 58 is represented generally as 300*b* and, for a general comparison, a locked or delayed full valve lift is illustrated generally as 302. Although the added motion movement of the engine valve 58 is illustrated as being part of an intake curve, it will be appreciated that the invention is not limited to the intake stroke of an intake engine valve 58, and, for example, the added motion movement of the engine valve 58 may also be applied to the exhaust stoke of an engine exhaust valve 58.

Figure 8:
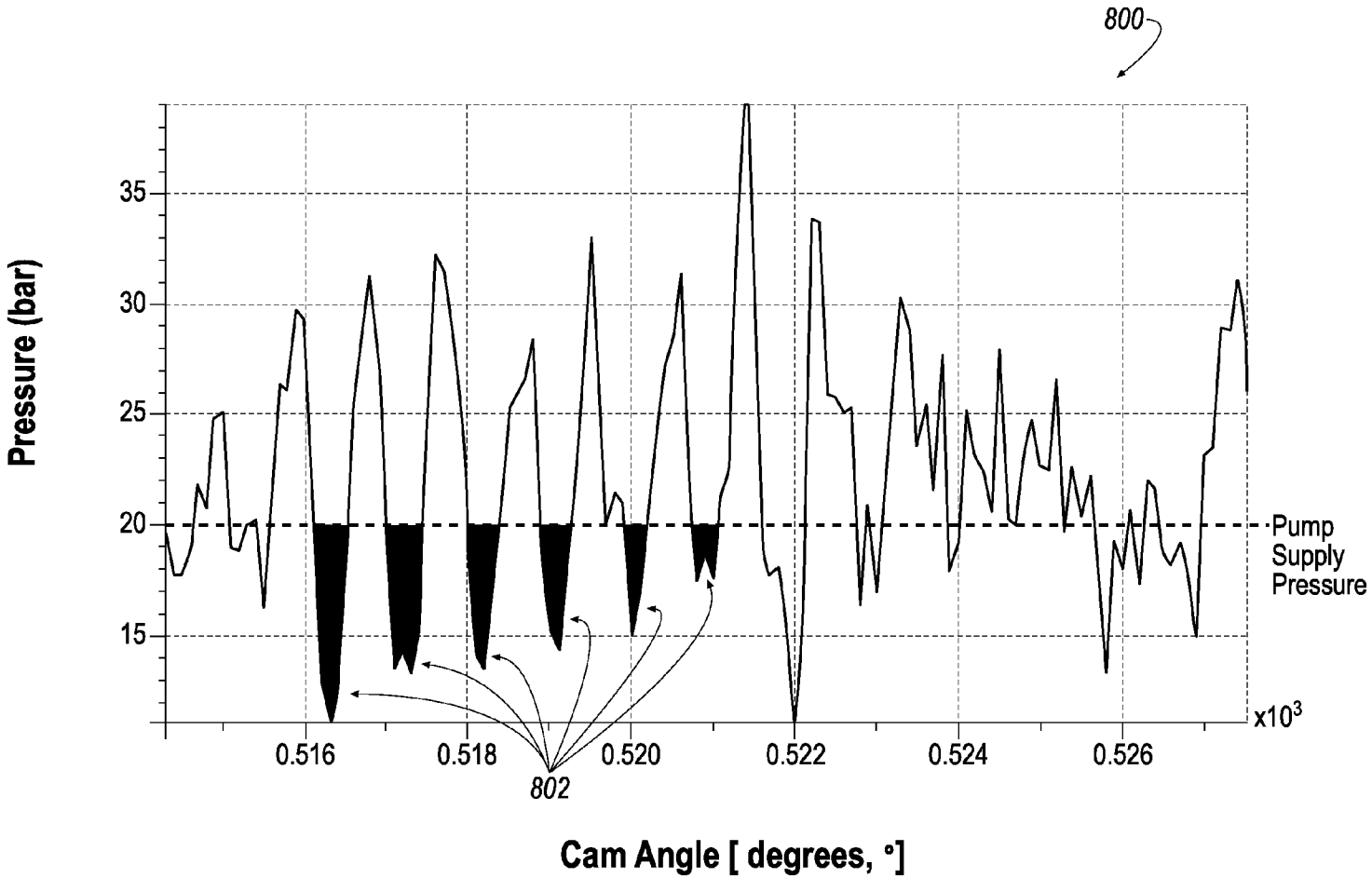
FIG. 8 is a sampling of the plot of FIG. 7.

During the closing movement of the engine valve 58, which is represented generally as segment 304 on curve 300*b*, energy stored in the valve spring 60 that is commonly "lost" may be recovered by storing an increased fluid pressure in the pressure rail 12 that is approximately equal to, but less than an engine valve spring seating/closing pressure. Accordingly, the energy stored in the valve spring 60 may be returned through the inclusion of increased pressure in the rail 12 rather than being dissipated as increased fluid velocity or heat arising from fluid friction as associated fluid evacuation from conventional added motion systems. Thus, at approximately an end 306 of the added-motion full valve lift 302, the fluid 11 in the actuator fluid volume 62 may be evacuated through the valve 25 and reintroduced into the pressure rail 12, which, at this instance, may increase the pressure of the fluid 11 in the pressure rail 12. As seen in FIG. 8, pressure waves 802 generated by the reintroduction of fluid into the pressure rail 12 will cause a low pressure in the pressure rail 12 at the check valve 18, which will then cause fluid to be drawn in and assist in the increasing of pressurization of the pressure rail 12.

Referring to FIG. 1, to ensure energy recovery from the engine valve spring 60, it may be desirable to decreased pressure of fluid 11 in the pressure rail 12, and, this pressure reduction may be accomplished, for example, by including a dump valve 22 that is connected to the pressure rail 12. In the embodiment, dump valve 22 is connected (in parallel to check valve 18) to the pump 16 and pressure rail 12. When the valve 25 evacuates the fluid 11 into the pressure rail 12, the dump valve 22 controls the increased fluid pressure in the pressure rail 12 at an appropriate level and can, even momentarily, decrease the pressure in the pressure rail 12 at an appropriate level so that the fluid 11 can be drawn from the valve 25 into the pressure rail 12, and/or, into a subsequent valve 25*a*-25*k*.

Thus, the combination of the check valve 18 and dump valve 22 minimizes energy losses associated with the valve spring 60 during the closing movement of the engine valve 58. Accordingly, a higher pressure provided by the check valve 18 and the control of decreased fluid pressure in the pressure rail 12 by the dump valve 22 can allow the engine valve spring 60 to cooperatively operate with cam system 75 so that higher power demands need not be placed on an IC engine during the closing movement 304 of the engine valve 58 in the added motion system 100.

Figure 4:
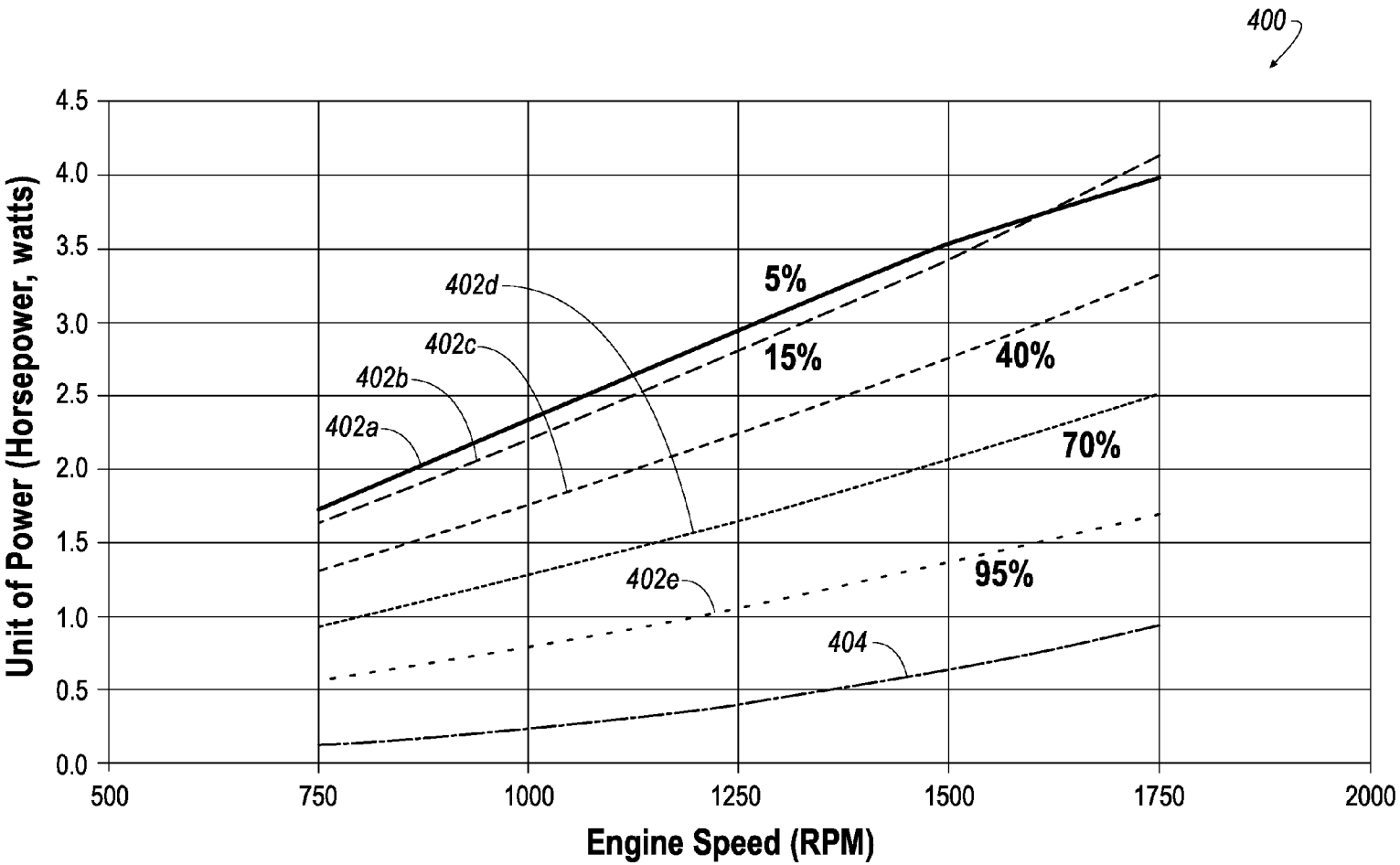
FIG. 4 is a chart illustrating power consumption (i.e. power demands) vs. engine speeds for various ratios of fluid pressure over pressure provided by an engine valve spring.

As seen in FIG. 4, for example, a chart illustrating power consumption (i.e. power demands) vs. engine speed is shown generally at 400 according to an embodiment. The units on the left side (i.e. y-axis) of the chart 400 is a "unit of power," which may be, for example, horsepower, watts, or the like. The units of power displayed on the left side of the chart 400 may depend on the engine being utilized, such as, for example, a 2-, 10-, 12-, or 550-liter engine. The units on bottom (i.e. x-axis) of the chart 400 is engine speed in rotations per minute (RPM). The plots 402*a*-402*e* on the chart 400 represent a power consumption for an added motion valve system 100. Additionally, each plot 402*a*-402*e* is differentiated from one another in view of a ratio of fluid pressure in the supply rail 12 over an equivalent engine valve spring pre-load pressure (i.e. the fluid pressure in the pressure rail 12 applied to the actuator piston area 62 can not generate a greater force than a pre-load force applied by the engine valve spring 60) when the added motion intake curve 300*b* is applied. The plot 404, however, generally represents a power consumption for an added motion valve system 100 when the added motion intake curve 300*b* is not applied (i.e., movement of the engine valve 58 generally follows the valve lift standard intake curve 300*a*). It should be noted, however, that if the fluid pressure in the pressure rail 12 generates a force that exceeds the force provided by the engine valve spring pre-load, the fluid pressure in the pressure rail 12 would otherwise undesirably control the seating/closing of the engine valve 58. Therefore, it is preferable to maintain a fluid pressure in the pressure rail 12 that does not generate a force that is greater than the force provided by the engine valve spring 60. The fluid pressure in the pressure rail can be controlled by any number of pressure control techniques well known to those skilled in the art including the use of dump valves, such as dump valve 22.

As illustrated, the plots 402*a*-402*e*, may represent, respectively, for example, a fluid pressure in the pressure rail 12 that generates 5%, 15%, 40%, 70%, and 95% of the force provided by the engine valve spring pre-load. Thus, when the fluid pressure in the pressure rail 12 is 5% of the pressure provided by the engine valve spring pre-load at 750 RPM, the power consumption by the engine is approximately 1.75 units. As the fluid pressure in the pressure rail 12 is increased to 95% of the pressure provided by the engine valve spring pre-load at 750 RPM, the power consumption by the engine is approximately 0.5 units, which is much closer to the regular, "no added motion" plot 404 where power consumption by the engine at 750 RPM is approximately 0.15 units.

Accordingly, it is preferable to operate the hydraulic circuit 10 at the plot 402*e* where the ratio of fluid pressure in the pressure rail 12 generates in the range of 95% or greater (but less than 100%) of the forces provided by the valve spring pre-load.

Thus, in view of the plots 402*a*-402*e*, as fluid pressure in the pressure rail 12 is increased, the hydraulic circuit 10 reduces the power needed to open the engine valve 58 by the camshaft 77 due to the torsional forces returned to the cam system 75 by the valve spring 60. Since torsional forces can be provided by the valve spring 60 to the cam system 75, power from the IC engine needed for driving the cam system 75 may be reduced when compared with such power losses associated with valve springs of conventional added motion systems.

Figure 5:
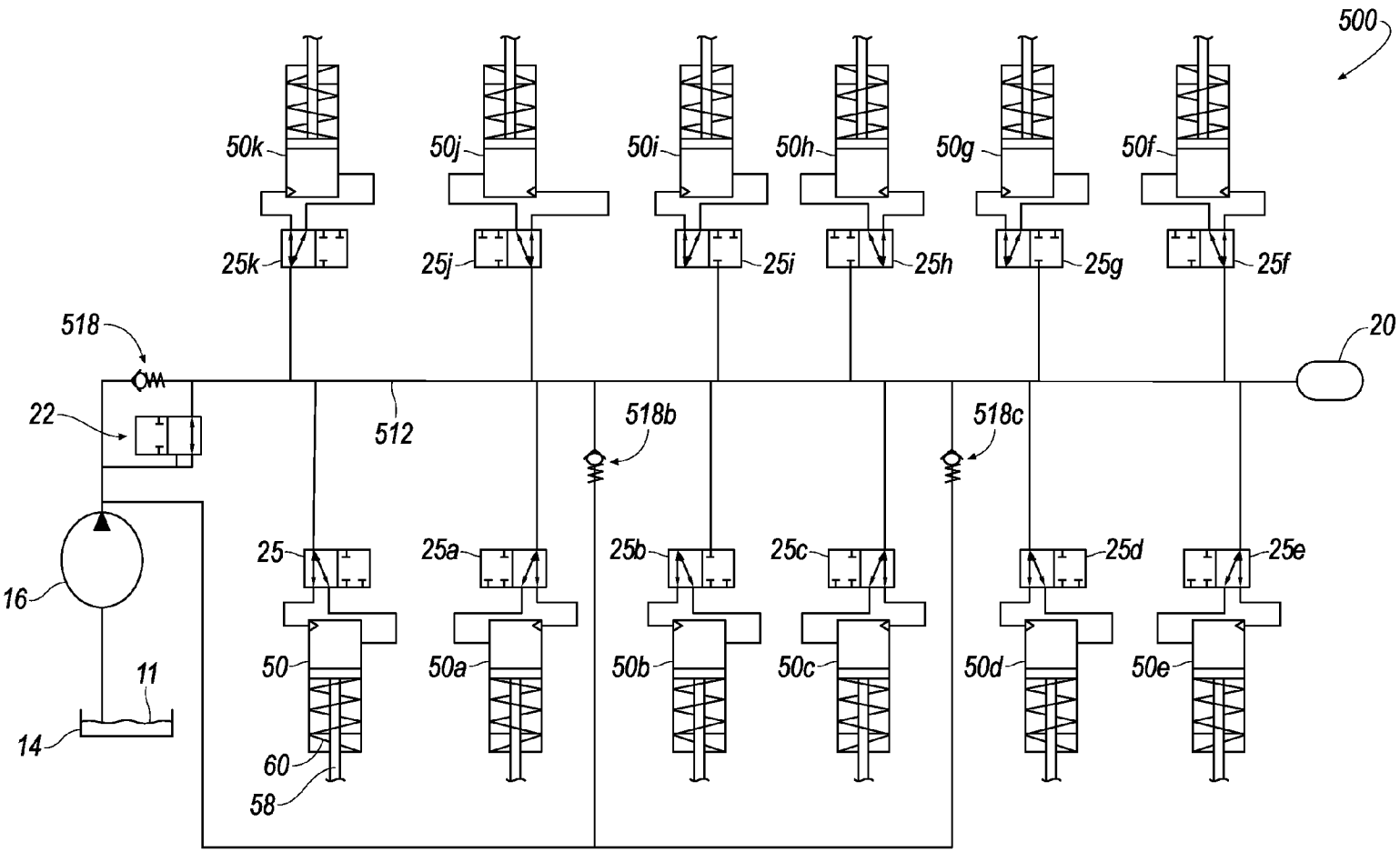
FIG. 5 is a hydraulic schematic for operating one or more added motion valve systems according to an embodiment of the present invention.

Referring now to FIG. 5, a hydraulic circuit according to an embodiment of the present invention is shown generally at 500. The hydraulic circuit 500, which may be employed in connection with an internal combustion (IC) engine, includes a plurality of actuators 25-25*k* and actuating mechanisms 50-50*k*. Embodiments of a valve 25, an actuating mechanism 50, and a representative view of a cam system 75 are generally shown in cross-section in FIG. 2. The valve 25, actuating mechanism 50, and cam system 75 may also be collectively referred to as an added motion valve system 100.

The hydraulic circuit 500 is substantially similar to the hydraulic circuit 10 of FIG. 1 with the exception that the hydraulic circuit 500 includes a plurality of one-way directional flow check valves which are shown generally at 518*a*-518*c*. The check valve 518*a* is situated in a substantially similar location as the check valve 18 of FIG. 1. The check valves 518*b*, 518*c*, are, however, shown branching off of the pressure rail 512 between actuating mechanisms 50*a*, 50*b* and 50*c*, 50*d*, respectively. It will be appreciated that the invention is not limited to two additional check valves 518*b*, 518*c*, and may, for example, include any desirable number of additional check valves, such as, for example, one or more check valves, that are positioned between any of the actuating mechanisms 50-50*k*.

Figure 6:
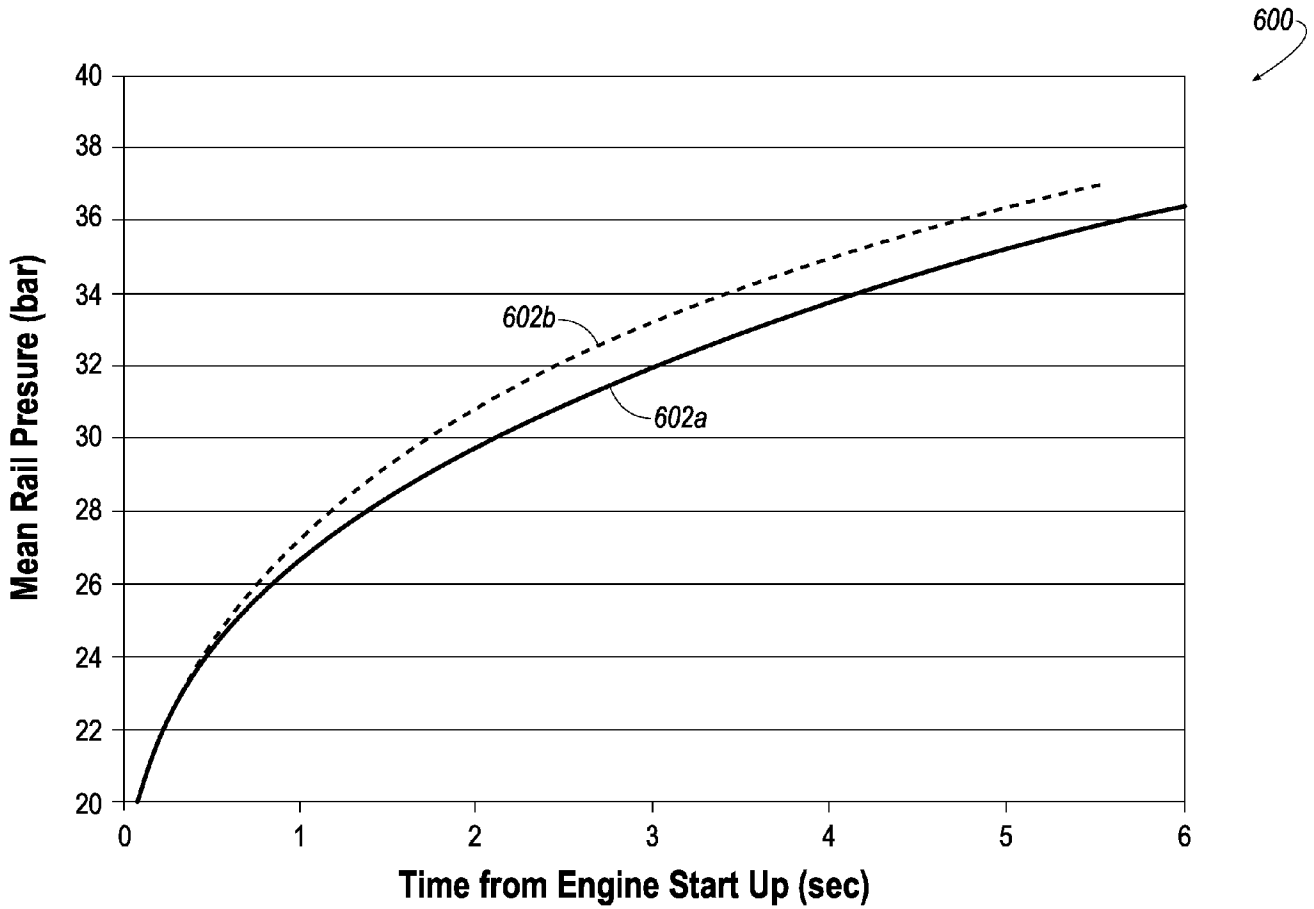
FIG. 6 is a chart that illustrates a response time for an amount of fluid pressure boost in a pressure rail for the hydraulic schematic for operating one or more added motion valve systems according to FIGS. 1 and 5.

Referring to FIG. 6, a chart 600 illustrates a response time for an increase in the amount of fluid pressure in the pressure rail 12, 512 for the hydraulic circuits 10, 500, respectively. The plot line 602*a* generally represents a fluid pressure increase response time for the hydraulic circuit 10 including one check valve 18 whereas the plot line 602*b* generally represents pressure boost response time for the hydraulic circuit 500 including three check valves 518*a*-518*c*. As illustrated, a desired, increased fluid pressure in the pressure rail 512 may be achieved faster than a desired fluid pressure in the pressure rail 12 when one or more additional check valve 518*b*, 518*c* attached to the pressure rail 512. In such circumstances, when the fluid pressure falls below the supply pressure, additional check valves 518*b*, 518*c* (i.e. check valves that supplement, for example, check valve 518*a*) may, accordingly, boost the increased fluid pressure in the pressure rail 512. Accordingly, the additional check valves 518*b*, 518*c* allow the hydraulic circuit 500 to hasten the time for arriving at a mean fluid pressure in the pressure rail 512.

Figure 7:
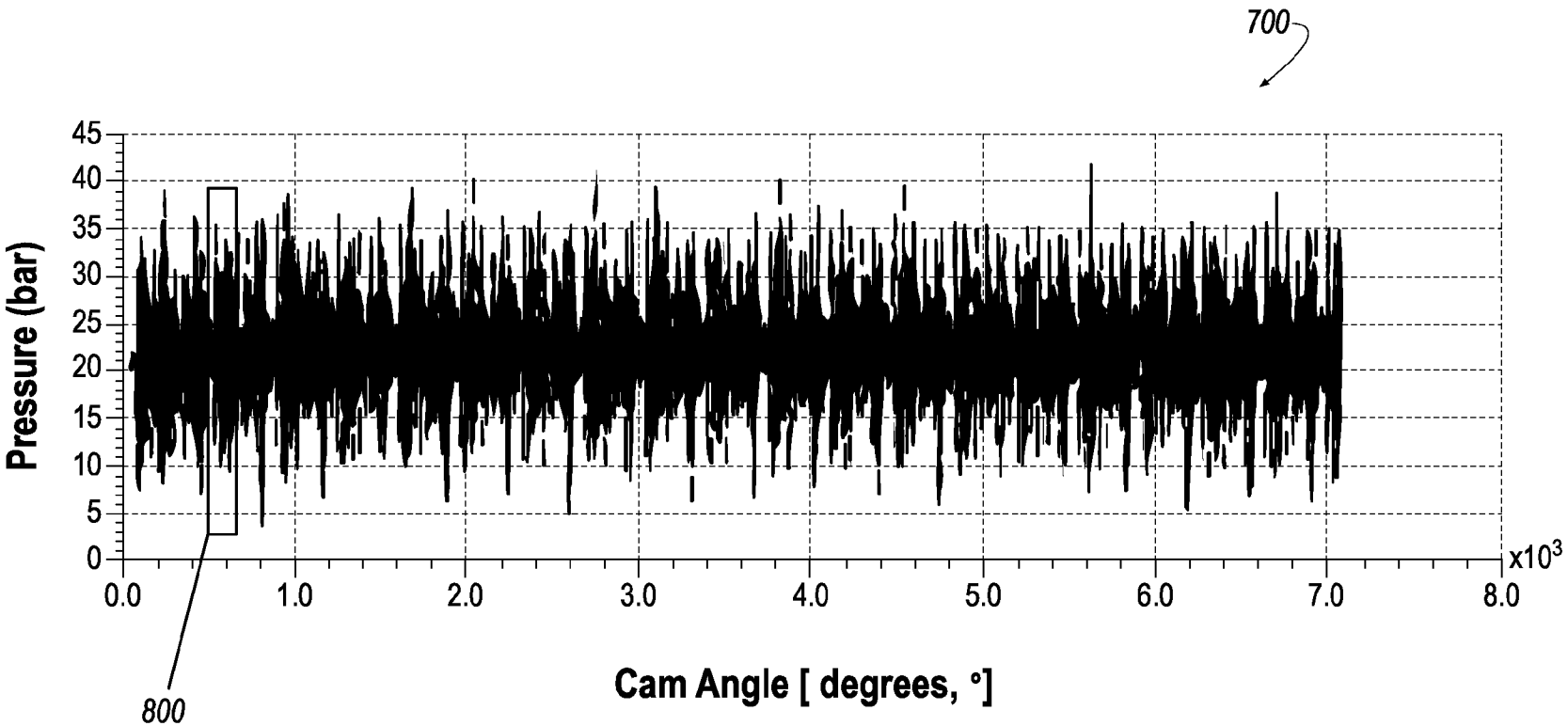
FIG. 7 is a plot of fluid pressure in a pressure rail for an activated hydraulic circuit.

Referring to FIG. 7, a plot of fluid pressure in the pressure rail 12, 512 for an activated hydraulic circuit 10, 500 is generally shown at 700. The supply pressure of the fluid 11 to the rail 12, 512 may be on average, for example, 20-bar. Referring also to FIG. 8, a sampling of the plot 700 is generally shown at 800. As shown in the sampling 800, the fluid pressure in the pressure rail 12, 512 may, at times, be boosted above 20-bar due to the inclusion of check valves 18, 518*a*-518*c*, and, at times, fall below the 20-bar supply pressure, which is shown generally at 802. Accordingly, when the fluid pressure falls below the supply pressure, the check valves 18, 518*a*-518*c* may, accordingly, boost fluid pressure in the pressure rail 512 to allow the hydraulic circuit 10, 500 to quickly arrive at a mean fluid pressure in the pressure rail 512.

The present invention has been particularly shown and described with reference to the foregoing embodiments, which are merely illustrative of the best mode or modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A hydraulic circuit, comprising:
an added motion intake stroke assembly and an added motion exhaust stroke assembly, wherein each of the added motion intake stroke assembly and the added motion exhaust stroke assembly includes
an added motion valve system including
a cam system,
an actuating mechanism including an actuator fluid volume, an engine valve and an engine valve spring, and
a valve in fluid communication with the actuator mechanism, wherein the added motion valve system provides
means for arranging the valve in a first orientation for permitting fluid to move into the actuator fluid volume and subsequently arranging the valve in a second orientation for impeding movement of the fluid within the actuating mechanism for causing the engine valve to be arranged in a locked orientation;
a dump valve; and
at least one check valve, wherein the dump valve and the at least one check valve are in fluid communication with the valve of the added motion valve system, wherein the dump valve and the at least one check valve provides
means for recovering energy stored in the engine valve spring during the closing movement of the engine valve of the added motion valve system.

2. The hydraulic circuit according to claim 1, wherein the engine valve of the added motion intake stroke assembly is an intake engine valve, and wherein a closing movement of the intake engine valve is during an added motion intake stroke of the intake engine valve, wherein the means for recovering energy stored in the engine valve spring occurs during:
the closing movement of the intake engine valve.

3. The hydraulic circuit according to claim 1, wherein the engine valve of the added motion exhaust stroke assembly is an exhaust engine valve, and wherein a closing movement of the exhaust engine valve is during an added motion exhaust stroke of the exhaust engine valve, wherein the means for recovering energy stored in the engine valve spring occurs during:
the closing movement of the exhaust engine valve.

4. The hydraulic circuit according to claim 1 further comprising
a pressure rail that is in fluid communication with:
the valve of the added motion valve system,
the dump valve, and
the at least one check valve.

5. The hydraulic circuit according to claim 4, wherein the dump valve provides
means for momentarily decreasing fluid pressure in the pressure rail.

6. The hydraulic circuit according to claim 4, wherein the at least one check valve provides
means for increasing fluid pressure in the pressure rail.

7. The hydraulic circuit according to claim 4 further comprising an accumulator in fluid communication with the pressure rail, wherein the accumulator provides means for controlling fluid pressure dynamics of fluid in the pressure rail.

8. The hydraulic circuit according to claim 4, wherein the dump valve is fluidly connected, in parallel, to the at least one check valve.

9. The hydraulic circuit according to claim 4, wherein the at least one check valve provides means for increasing fluid pressure in the pressure rail, wherein the dump valve provides means for decreasing the fluid pressure in the pressure rail.

10. The hydraulic circuit according to claim 9, wherein the combination of the at least one check valve and the dump valve provides means for minimizing energy losses associated with the engine valve spring of each of the added motion intake stroke assembly and the added motion exhaust stroke assembly for recovering energy stored in the engine valve spring during a closing movement of the engine valve of each of the added motion intake stroke assembly and the added motion exhaust stroke assembly.

11. The hydraulic circuit according to claim 1, wherein the locked orientation of the engine valve occurs at full valve lift.

12. A method for controlling a hydraulic circuit including an added motion assembly, comprising the steps of:

opening an engine valve of an engine valve actuating mechanism by way of a cam system;

compressing and storing energy in an engine valve spring during the opening movement of the engine valve;

imparting added motion stroke movement to the engine valve by impeding movement of fluid within an actuating mechanism of the added motion assembly for locking the opening movement of the engine valve and delaying a closing movement of the engine valve;

evacuating the fluid from within the actuating mechanism of the added motion assembly to permit added motion closing movement of the engine valve; and recovering the stored energy in the engine valve spring and returning the energy stored in the engine valve spring to the cam system.

13. The method according to claim 12, wherein the added motion stroke movement is during an intake stroke of the intake engine valve.

14. The method according to claim 12, wherein the added motion stroke movement is during an exhaust stroke of the exhaust engine valve.

15. A hydraulic circuit, comprising:

a plurality of added motion valve systems, wherein each of the plurality of added motion valve systems include a cam system, an actuating mechanism including an actuator fluid volume, an engine valve and an engine valve spring, and a valve in fluid communication with the actuator mechanism, wherein the added motion valve system provides means for arranging the valve in a first orientation for permitting fluid to move into the actuator fluid volume and subsequently arranging the valve in a second orientation for impeding movement of the fluid within the actuating mechanism for causing the engine valve to be arranged in a locked orientation;

a dump valve; and at least one check valve, wherein the dump valve and the at least one check valve are in fluid communication with the valve of the added motion valve system, wherein the engine valve of each of the plurality of added motion valve systems includes one or more intake engine valves, and one or more exhaust engine valves, wherein a closing movement of the one or more intake engine valves and the one or more exhaust engine valves occurs during an added motion intake stroke, wherein the dump valve and the at least one check valve provides means for recovering energy stored in the engine valve spring during the closing movement of the one or more intake engine valves and the one or more exhaust engine valves.

* * * * *